US006832948B1

(12) United States Patent
Birang et al.

(10) Patent No.: US 6,832,948 B1
(45) Date of Patent: Dec. 21, 2004

(54) THERMAL PRECONDITIONING FIXED ABRASIVE ARTICLES

(75) Inventors: Manoocher Birang, Los Gatos, CA (US); Ramin Emami, San Jose, CA (US); Shijian Li, Santa Clara, CA (US); Fred C. Redeker, Fremont, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 09/454,354

(22) Filed: Dec. 3, 1999

(51) Int. Cl.[7] ..... B24B 1/00

(52) U.S. Cl. ..... 451/56; 451/53; 451/7; 451/443

(58) Field of Search ..... 451/53, 56, 7, 451/443

(56) References Cited

U.S. PATENT DOCUMENTS 5,014,468 A 5/1991 Ravipati et al.
5,127,196 A * 7/1992 Morimoto et al. ..... 451/7
5,453,312 A 9/1995 Haas et al.
5,454,844 A 10/1995 Hibbard et al.
5,643,050 A * 7/1997 Chen ..... 451/7
5,692,950 A 12/1997 Rutherford et al.
5,820,450 A 10/1998 Calhoun
5,842,910 A 12/1998 Krywanczyk et al.
5,873,769 A * 2/1999 Chiou et al. ..... 451/7
5,957,750 A * 9/1999 Brunelli ..... 451/56
5,958,794 A 9/1999 Bruxvoort et al.
5,993,298 A * 11/1999 Duesher ..... 451/56

* cited by examiner

*Primary Examiner*—Eileen P. Morgan
(74) *Attorney, Agent, or Firm*—McDermott Will & Emery

(57) ABSTRACT

The CMP removal rate of a fixed abrasive article is increased and wafer-to-wafer uniformity enhanced by thermal preconditioning. Embodiments include preconditioning a fixed abrasive article by heating with hot water to a temperature of about 90° C. to about 100° C. to increase and stabilize the Cu or Cu alloy CMP removal rate.

16 Claims, 4 Drawing Sheets

THERMAL PRECONDITIONING FIXED ABRASIVE ARTICLES

TECHNICAL FIELD

The present invention relates to a method of preconditioning a fixed abrasive article containing a plurality of abrasive elements and to a chemical mechanical polishing (CMP) technique using a fixed abrasive article. The present invention has particular applicability in polishing operations conducted in manufacturing semiconductor devices.

BACKGROUND ART

Abrasive articles enjoy utility in a variety of industrial applications for abrading, finishing and polishing a variety of surfaces. Typical industrial uses of abrasive articles include polishing a substrate, as in manufacturing magnetic recording media and during various phases in manufacturing semiconductor devices. In manufacturing semiconductor devices, a wafer typically undergoes numerous processing steps, including deposition, patterning and etching. After various processing steps it is necessary to achieve a high level of surface planarity and uniformity to enable accurate photolithographic processing. A conventional planarization technique comprises polishing, as by CMP, wherein a wafer carrier assembly is rotated in contact with a polishing pad in a CMP apparatus. The polishing pad is mounted on a rotating/moving turntable or platen driven by an external driving force. The wafers are typically mounted on a carrier or polishing head which provides a controllable force, i.e., pressure, pressing the wafers against the rotating polishing pad. Thus, the CMP apparatus effects polishing or rubbing movement between the surface of each thin semiconductor wafer and the polishing pad while dispersing a polishing slurry containing abrasive particles in a reactive solution to effect both chemical activity and mechanical activity while applying a force between the wafer and a polishing pad.

Conventional polishing pads employed in abrasive slurry processing typically comprise a grooved porous polymeric surface, such as polyurethane, and the abrasive slurry varied in accordance with the particular material undergoing CMP. Basically, the abrasive slurry is impregnated into the pores of the polymeric surface while the grooves convey the abrasive slurry to the wafer undergoing CMP. A polishing pad for use in CMP slurry processing is disclosed by Krywanczyk et al. in U.S. Pat. No. 5,842,910. Typical CMP is performed not only on a silicon wafer itself, but on various dielectric layers, such as silicon oxide, conductive layers, such as aluminum (Al), copper (Cu) and alloys thereof, or a layer containing both conductive and dielectric materials as in damascene processing.

A distinctly different type of abrasive article from the above-mentioned abrasive slurry-type polishing pad is a fixed abrasive article, e.g., fixed abrasive polishing sheet or pad. Such a fixed abrasive article typically comprises a backing with a plurality of geometric abrasive composite elements adhered thereto. The abrasive elements typically comprise a plurality of abrasive particles in a binder, e.g., a polymeric binder. During CMP employing a fixed abrasive article, the substrate or wafer undergoing CMP wears away the fixed abrasive elements thereby exposing the abrasive particles. Accordingly, during CMP employing a fixed abrasive article, a chemical agent is dispersed to provide the chemical activity, while the mechanical activity is provided by the fixed abrasive elements and abrasive particles exposed by abrasion with the substrate undergoing CMP.

Thus, such fixed abrasive articles do not require the use of a slurry containing loose abrasive particles and advantageously reduce, effluent treatment and dishing as compared to polishing pads that require an abrasive slurry. During CMP employing a fixed abrasive polishing pad, a chemical agent is applied to the pad, the agent depending upon the particular material or materials undergoing CMP. However, the chemical agent does not contain abrasive particles as in abrasive slurry-type CMP operations. Fixed abrasive articles are disclosed by Rutherford et al. in U.S. Pat. No. 5,692,950, Calhoun in U.S. Pat. No. 5,820,450, Haas et al. in U.S. Pat. No. 5,453,312and Hibbard et al. in U.S. Pat. No. 5,454,844.

Fixed abrasive elements are typically formed by filling recesses in an embossed carrier with a slurry comprising a plurality of abrasive grains dispersed in a hardening binder precursor and hardening the binder precursor to form individual abrasive composite elements that are laminated to a backing sheet and the embossed carrier removed. Fixed abrasive elements of conventional slurry-less type polishing pads are typically formed in various "positive" geometric configurations, such as a cylindrical, cubical, truncated cylindrical, and truncated pyramidal shapes, as disclosed by Calhoun in U.S. Pat. No. 5,820,450. Conventional fixed abrasive articles also comprise "negative" abrasive elements, such as disclosed by Ravipati et al. in U.S. Pat. No. 5,014,468.

During CMP, the surface of conventional polymeric polishing pads for abrasive-slurry type CMP operations becomes glazed and, thus, nonreceptive to accommodating and/or dispensing the abrasive slurry and is otherwise incapable of polishing at a satisfactory rate and uniformity. Accordingly, conventional practices comprise periodically conditioning the pad surface so that it is maintained in a proper form for CMP. Conventional conditioning means comprises a diamond or silicon carbide (SiC) conditioning disk to conditioning the polishing pad. After repeated conditioning operations, the pad is eventually consumed and incapable of polishing at a satisfactory rate and uniformity. At this point, the polishing pad must be replaced. During replacement, the CMP apparatus is unavailable for polishing with an attendant significant decrease in production throughput.

On the other hand, fixed abrasive pads do not undergo the same type of adverse smoothing as do conventional polymeric polishing pads. In addition, a fixed abrasive pad has a low contact ratio (area of the tops of abrasive elements/total pad area), such as about 10% to about 25%, e.g., about 18%, and short abrasive elements. Periodic pad conditioning with conventional conditioning means would drastically reduce the pad lifetime on a CMP apparatus having a rotating round platen. Preconditioning only would be expected to adversely affect the polishing rate and uniformity stability, i.e., wafer-to-wafer uniformity, since preconditioning with conventional diamond or SiC disks would be expected to render the pad surface significantly different from that caused by pad-wafer interactions. Accordingly, conventional practices on fixed abrasive pads do not involve preconditioning, i.e., prior to initial CMP, or even periodic conditioning, after initial CMP. However, the use of fixed abrasive articles, such as polishing pads, disadvantageously results in poor wafer-to-wafer polishing rate stability on a CMP polisher having a rotating round platen or on a polisher with an advanceable polishing sheet at an indexing rate less than 0.5 to 1.0 inch per minute.

It was found that unused fixed abrasive articles exhibit a very slow initial polishing rate of about 100 minutes, particularly when CMP metals, such as Cu or Cu alloys. Such a long CMP break-in period is impractical in the competitive marketplace which demands high production through-put and low manufacturing costs.

There exists a need to extend the useful life of a fixed abrasive article, e.g., polishing sheet or pad, while simultaneously maintaining high wafer-to-wafer rate stability. There also exists a need for methodology enabling rapid preconditioning fixed abrasive elements for use in CMP, particularly for CMP metals, such as Cu and Cu alloys, at high removal rates.

DISCLOSURE OF THE INVENTION

Figure 1:
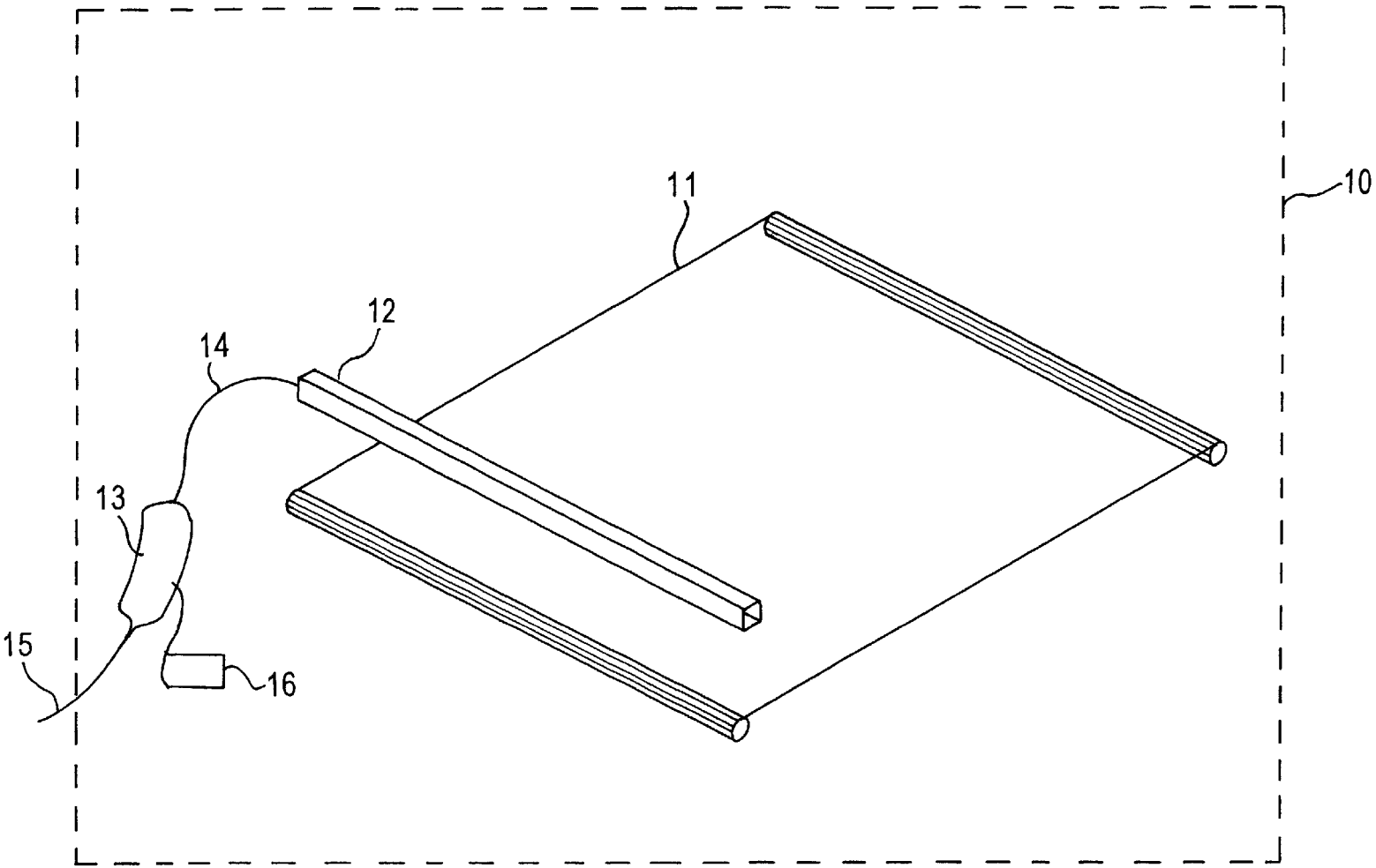
FIGS. 1 and 2 schematically illustrate embodiments of the present invention employing a hot water dispenser.

An aspect of the present invention is a method of preconditioning a fixed abrasive article to increase its CMP removal rate.

Another aspect of the present invention is a method of preconditioning a fixed abrasive article to achieve high wafer-to-wafer CMP rate stability.

Another aspect of the present invention is a method of CMP semiconductor wafers with a high removal rate and improved wafer-to-wafer polishing rate stability using a fixed abrasive article.

Additional aspects and other features of the present invention will be set forth in part in the description which follows and in part will become apparent to those having ordinary skill in the art upon examination of the following or may be learned from the practice of the present invention. The aspects of the present invention may be realized and obtained as particularly pointed out in the appended claims.

According to the present invention, the foregoing and other aspects are implemented in part by a method of preconditioning a fixed abrasive article comprising a plurality of abrasive elements before initial use in (CMP) a surface of a workpiece, the method comprising heating the fixed abrasive article.

Another aspect of the present invention is a method of CMP a wafer surface with a fixed abrasive element, the method comprising sequentially: heating to preconditioning the fixed abrasive article; and CMP the wafer surface.

Another aspect of the present invention is an apparatus comprising: a fixed abrasive element; and means for heating the fixed abrasive element. Embodiments include heaters, such as hot water dispensers, and heating elements, such as coils within a supporting platen.

Embodiments of the present invention comprise preconditioning a fixed abrasive article by heating with hot water at a temperature of about 90° C. to about 100° C., thereby significantly increasing the CMP removal rate of the fixed abrasive article when planarizing a wafer surface containing Cu or Cu alloys, as in damascene processing. Embodiments of the present invention also include preconditioning by applying hot water to the fixed abrasive element prior to or after mounting in a CMP apparatus.

Additional aspects of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without departing from the present invention. Accordingly, the description is to be regarded as illustrative in nature, and not as restrictive.

DESCRIPTION OF THE INVENTION

The present invention addresses and solves the wafer-to-wafer polishing rate stability and initial slow CMP removal rate problems attendant upon CMP employing conventional fixed abrasive articles, such as fixed abrasive polishing pads or sheets. During initial CMP, particularly when planarizing a wafer containing a metal, such as Cu or a Cu alloy, the fixed abrasive polishing pad exhibits an extremely slow polishing rate for periods of up to about 100 minutes. Typically, a polishing rate of at least 2,000 Å/min, such as about 3,000 to about 4,000 Å/min, is targeted. An optimal removal rate for CMP removal of a particular material, such as Cu or a Cu alloy, is determined by adjusting the CMP parameters to achieve a desirably high stable removal rate, e.g., about 3,000 Å/min. However, when employing new fixed abrasive polishing pads, the removal rate was determined to be undesirably low and unstable, e.g., about 1,500 Å/min.

The present invention provides a thermal preconditioning treatment for fixed abrasive pads thereby achieving an immediate removal rate of about 3,000 Å/min vis-à-vis about 1,500 Å/min for the unpreconditioned state. In accordance with embodiments of the present invention, thermal preconditioning comprises heating the fixed abrasive article to a suitable temperature, such as at least about 90° C., e.g., about 90° C. to about 100° C., for a suitable time, such as about 10 minutes to about 30 minutes, e.g., about 15 minutes to 30 minutes, notably about 20 minutes.

Given the guidance and objectives of the present disclosure, it should be appreciated that any convenient means of elevating the temperature of the fixed abrasive article can be employed. For example, the fixed abrasive article can be immersed in hot water prior to mounting on the platen of a CMP apparatus. Alternatively, hot water can be applied to the pad after it is mounted on a CMP apparatus, as by dispensing hot water onto the fixed abrasive linear sheet rotatable pad, e.g., dispensing through a spray nozzle. Other conventional heating means can be employed, such as radiant heating.

It was found that the heat treatment of fixed abrasive articles in accordance with the present invention resulted in the planarization of metallic surfaces having fewer defects. It was observed that conventional fixed abrasive elements contained embedded debris on their surfaces which cause defects, such as scratching, on a planarized surface. However, in accordance with the present invention, heat treatment, particularly employing hot water, removes such embedded debris, thereby enabling planarization of metallic surfaces with significantly reduced defects, e.g., scratches.

The precise mechanism underpinning the relatively rapid preconditioning achievable by thermal treatment in accordance with the present invention is not known with certainty.

Another embodiment of the present invention comprises initially preconditioning a fixed abrasive article, such as a fixed abrasive polishing sheet or pad, by thermal treatment at an elevated temperature, e.g., at about 90° C. or higher, followed by initial CMP of at least one wafer. The present invention is applicable to CMP various surfaces, including metals, dielectric materials, such as silicon dioxide, as well as surfaces comprising a dielectric material and a metal, such as silicon dioxide and Cu or a Cu alloy.

The present invention is applicable to any type of CMP employing any type of fixed abrasive element, such as linear sheets and rotatable pads. An embodiment of the present invention is schematically illustrated in FIG. 1 and comprises a conventional fixed abrasive polishing sheet 11, as part of a CMP apparatus indicated by phantom line 10, the details of which are omitted for a clearer understanding of the inventive contribution. As shown in FIG. 1, dispensing means, i.e., spray nozzle 12, is positioned above fixed abrasive sheet 11. Hot water is conveyed through line 14 into spray nozzle 12 from container 13 fed with water through line 15 from a water source (not shown). Water in container 13 is maintained at an elevated temperature, e.g., at about 90° C. to about 100° C., by controller 16 and heating element therein (not shown). Alternatively, line 14 can be directly connected to a hot water source external to the CMP apparatus 10.

Figure 2:
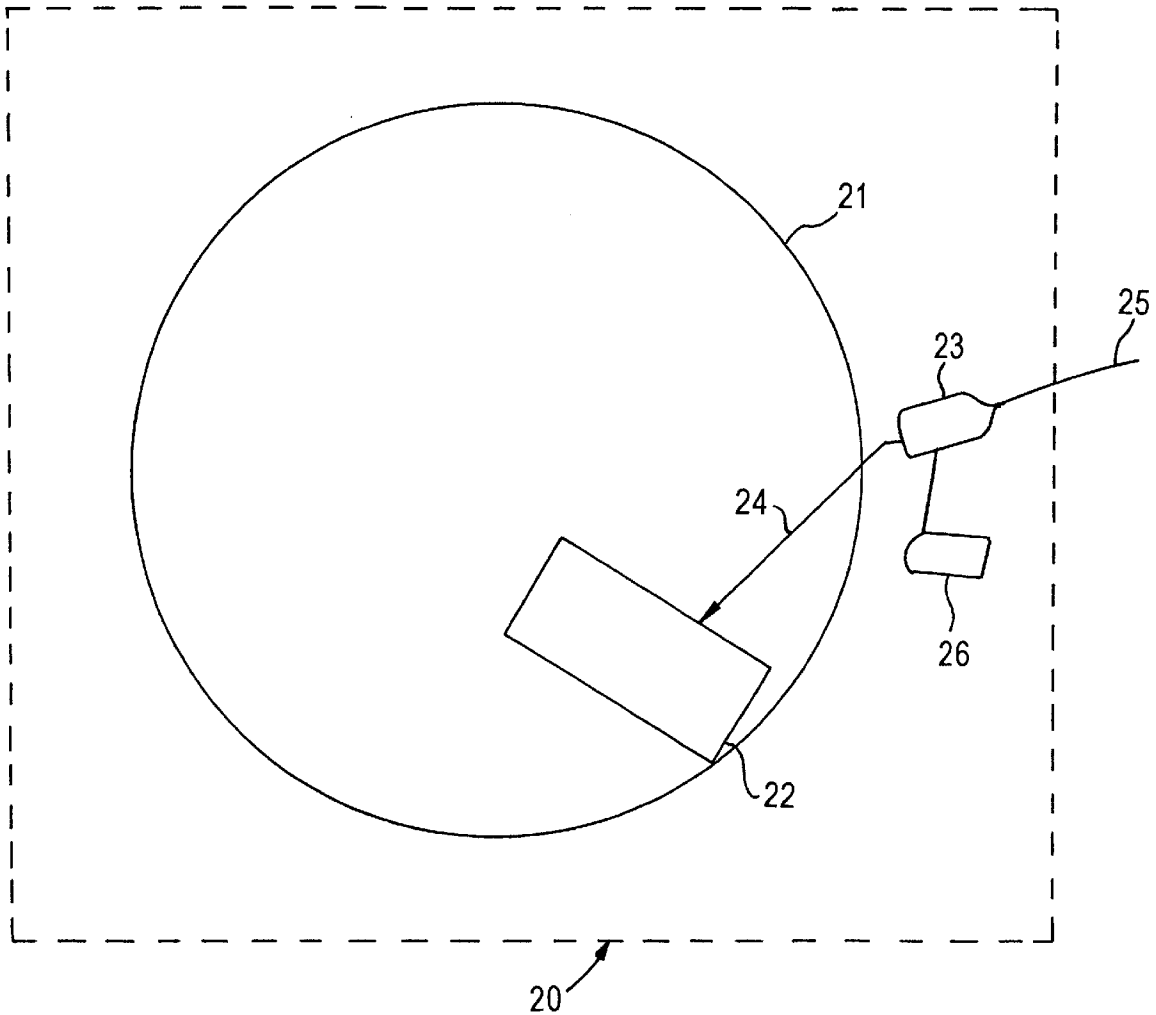

Another embodiment of the present invention is schematically illustrated in FIG. 2 and comprises substantially circular fixed abrasive polishing pad 21 designed for rotating motion as part of a CMP apparatus which is illustrated by phantom line 20 for illustrative convenience. As shown in FIG. 2, dispensing means 22, e.g. spray nozzle, is positioned substantially along a radius of substantially circular fixed abrasive polishing pad 21 to dispense hot water thereon. Hot water could be fed directly through line 24 from an external source or, as illustrated, from heated container 23 fed by external water line 25 and maintained at a suitable temperature, e.g., about 90° C. to about 100° C., by controller 26.

Figure 3:
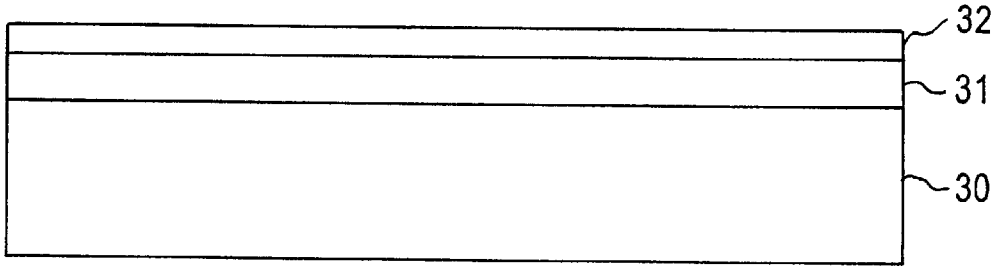
FIGS. 3–5 illustrate other embodiments of the present invention employing heating means.

Another embodiment of the present invention is illustrated in FIG. 3 and comprises platen 30, heating element 31 on or within platen 30, and fixed abrasive polishing pad 32.

Figure 4:
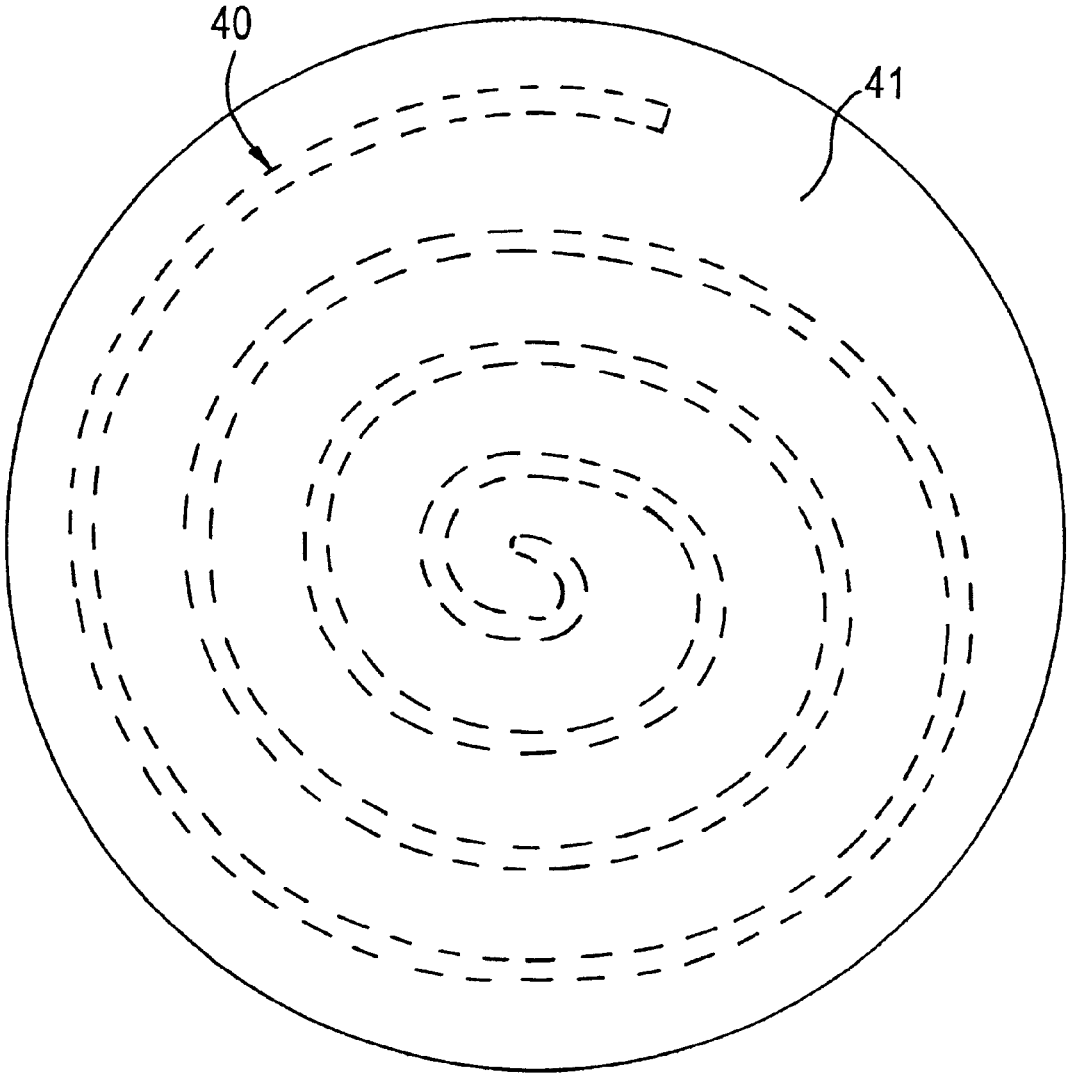

Heating in accordance with embodiments of the present invention can be implemented in any conventional manner. For example, the underlying platen can comprise channels through which a heated fluid, such as air or water, can be passed. In another embodiment, as schematically illustrated in FIG. 4, a heating filament 40 is embedded within platen 41, such as an upper surface thereof. In alternative embodiments, a controllable heated liquid or gas is introduced into the interior of the platen to controllably heat the platen. It should be understood that any type of heater can be used to implement the present invention.

Figure 5:
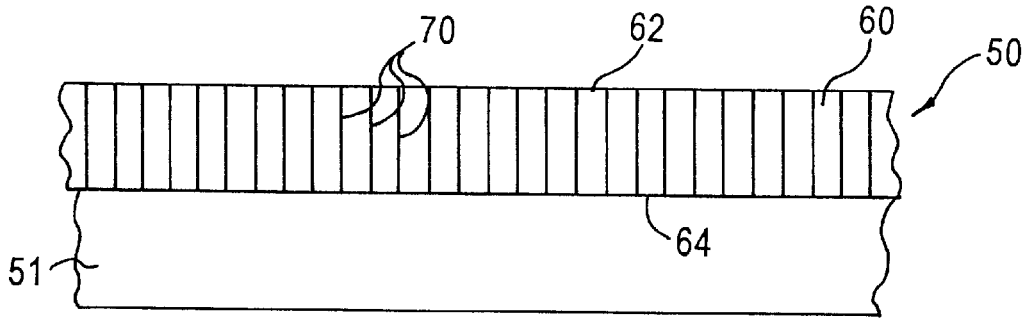

In another embodiment of the present invention, as schematically illustrated in FIG. 5, a deformable conductive underpad 50 is positioned on platen 51. Underpad 50 comprises a body portion 60 with the top surface 62 and bottom surface 64. Body portion 50 preferably comprises a continuous phase matrix material, such as polyurethane or Teflon®. A thermally conductive material, such as a plurality of thermal conductors 70, is positioned or mixed within a body portion 60. Thermal conductors 70 can comprise a material having a relatively high thermal conductivity of at least 0.5 W/m° K. Thermal conductors made from carbon fiber are particularly well suited to enhance thermal conductivity while providing adequate resilience and sufficient compressibility of the underpad 51. Thermal conductors 70 are preferably strands that extend from approximately the top face 62 through the bottom face 64 of body portion 60.

EXAMPLE

A fixed abrasive element was immersed in deionized water at a temperature of 90° C. for about 15 minutes. The fixed abrasive pad was then mounted in a CMP apparatus and employed to planarize a damascene inlay of Cu. An immediate removal rate of 3,000 Å/min was achieved. Thermal preconditioning in accordance with the present invention eliminated the 100 minute break-in period typically required for fixed abrasive pads having an initial low polishing rate.

The present invention is applicable to preconditioning any various types of conventional fixed abrasive articles, such as circular fixed abrasive polishing pads that are rotated, as well as rectangular fixed abrasive sheets which are rotated and indexed. Fixed abrasive sheets typically include an upper layer which is an abrasive composite composed of abrasive grains held or embedded in a binder material. Typically, the abrasive grains have a particle size of about 0.1 and about 1,500 microns. Such abrasive grains can include silicon oxide, fused aluminum oxide, ceramic aluminum, green silicon carbide, silicon carbide, chromia, alumina zirconia, diamond, iron oxide, ceria, cubic boron nitride, garnet, and combinations thereof. The binder may be derived from a precursor which includes an organic polimerizable resin which is cured to form the binder material. Examples of such resins include phenolic resins, urea-formaldehyde resins, melamine formaldehyde resins, acrylated urethanes, acrylated epoxies, ethylenically unsaturated compounds, aminoplast derivatives having at least one dependent acrylate group, isocyanurate derivatives having at least one pendent acrylate group, vinyl ethers, epoxy resins and combinations thereof. The lower layer is a backing layer composed of materials such as a polymeric film, paper, cloth or metallic film.

The present invention significantly enhances the useful life of conventional fixed abrasive articles, such as polishing sheets or pads, increase their initial CMP removal rate and improves wafer-to-wafer uniformity by thermal preconditioning the fixed abrasive articles, thereby significantly increasing production through-put. The present invention is applicable to all types of fixed abrasive articles. The present invention, therefore, enjoys utility in various industrial applications, particularly in CMP in the semiconductor industry as well as in the magnetic recording media industry.

Only the preferred embodiment of the present invention and but a few examples of its versatility are shown and described in the present disclosure. It is to be understood that the present invention is capable of use in various other combinations and environments and is capable of changes and modifications within the scope of the inventive concept as expressed herein.

What is claimed is:

1. A method of preconditioning a fixed abrasive article comprising a plurality of abrasive elements, the method comprising heating the fixed abrasive article before initial use in chemical-mechanical polishing (CMP) a surface of a workpiece.

2. The method according to claim 1, wherein the fixed abrasive article has an unstable first polishing rate prior to preconditioning and a second polishing rate, greater and more stable than the first polishing rate, after heating.

3. The method according to claim 2, wherein the fixed abrasive article has a removal rate of at least about 2,000 Å/min. after preconditioning.

4. The method according to claim 1, wherein the abrasive article comprises abrasive elements containing abrasive particles in a binder.

5. The method according to claim 4, wherein the abrasive article comprises abrasive particles dispersed in a polymeric binder.

6. The method according to claim 1, comprising heating the abrasive article to a temperature of at least about 90° C.

7. The method according to claim 6, comprising heating the abrasive article to a temperature of about 90° C. to about 100° C.

8. The method according to claim 6, comprising heating the abrasive article with hot water.

9. The method according to claim 6, comprising heating the abrasive article for about 10 minutes to about 30 minutes.

10. A method of CMP a wafer surface with a fixed abrasive element, the method comprising sequentially:

preconditioning the fixed abrasive article in accordance with the method of claim 1; and CMP the wafer surface.

11. The method according to claim 10, wherein the wafer surface comprises a metal.

12. The method according to claim 11, wherein the wafer surface comprises copper or a copper alloy.

13. The method according to claim 12, wherein the wafer surface further comprises a dielectric material.

14. The method according to claim 1, wherein:

the fixed abrasive elements contain embedded debris on their surfaces prior to heating; and heating reduces the amount of embedded debris.

15. The method according to claim 8, comprising dispensing the hot water on the abrasive article.

16. The method according to claim 8, comprising immersing the abrasive article in the hot water.

* * * * *